US005222272A

United States Patent [19]

Park

[11] Patent Number: 5,222,272

[45] Date of Patent: Jun. 29, 1993

[54] BRUSH

[75] Inventor: Young S. Park, Tokyo, Japan

[73] Assignee: Kabushiki Kaisha Y.S. Park New York, Tokyo, Japan

[21] Appl. No.: 832,605

[22] Filed: Feb. 12, 1992

Related U.S. Application Data

[63] Continuation of Ser. No. 638,266, Jan. 3, 1991, abandoned.

[30] Foreign Application Priority Data

| | | | |
|---|---|---|---|
| May 1, 1990 | [JP] | Japan | 2-45124 |
| Aug. 30, 1990 | [JP] | Japan | 2-91172 |
| Aug. 30, 1990 | [JP] | Japan | 2-91173 |
| Aug. 30, 1990 | [JP] | Japan | 2-91174 |

[51] Int. Cl.[5] ..... A46B 5/02

[52] U.S. Cl. ..... 15/159.1; 15/143.1; D4/138

[58] Field of Search ..... 15/143 R, 144 R, 159 R, 15/160, 167.1, 172, 206, 210 R; 16/110 R; 211/65; 248/110 R; D4/104, 129, 138; 132/120, 126, 150, 313

[56] References Cited

U.S. PATENT DOCUMENTS

| | | | |
|---|---|---|---|
| D. 167,775 | 9/1952 | Schmidt | 15/143 R |
| 461,604 | 10/1891 | Dietz | 15/206 |
| 1,398,864 | 11/1921 | Kelly | 15/143 R |
| 2,273,207 | 2/1942 | Kuhn | 15/167.1 |
| 2,467,284 | 4/1949 | Williams | 16/110 R |
| 2,483,503 | 10/1949 | Pollack | 15/167.1 |
| 2,532,780 | 12/1950 | Pettengill | 15/143 R |
| 2,914,785 | 12/1959 | Ela | 15/143 R |
| 3,047,898 | 8/1962 | Levite | 15/159 R |
| 4,184,221 | 1/1980 | Edwards | 15/143 R |
| 4,627,125 | 12/1986 | Gruns | 248/110 |

FOREIGN PATENT DOCUMENTS

| | | | |
|---|---|---|---|
| 662104 | 7/1938 | Fed. Rep. of Germany | 15/159 R |
| 813148 | 9/1951 | Fed. Rep. of Germany | 15/167.1 |
| 2522944 | 9/1983 | France | 15/167.1 |
| 54-41835 | 6/1979 | Japan . | |
| 8910076 | 11/1989 | PCT Int'l Appl. | 15/167.1 |
| 180027 | 12/1935 | Switzerland | 15/143 R |
| 605801 | 7/1948 | United Kingdom | 15/143 R |

*Primary Examiner*—Harvey C. Hornsby
*Assistant Examiner*—Mark Spisich
*Attorney, Agent, or Firm*—Lowe, Price, LeBlanc & Becker

[57] ABSTRACT

Plural through-holes are placed at a certain interval spacing on and along the grip of a brush to avoid slipping. Brush teeth and hard materials are implanted in a brush teeth implantation portion of the brush to facilitate the circulation of blood. The base and gripping portion of a rolling brush are connected by latches in opposite directions, and rotating directions can be selected at will. A passage is set along the center axis of the base of the brush, and plural connecting holes are arranged in the passage, reaching through to an outside round surface of the brush base. Implantation density of the brush teeth in the brush teeth implantation portion is not uniform.

4 Claims, 7 Drawing Sheets

BRUSH

This application is a continuation of application Ser. No. 07/638,266 filed Jan. 3, 1991, abandoned.

FIELD OF THE INVENTION

This invention relates generally to a brush, such as a body brush, a hair brush etc., and more particularly to a brush having a non-slip grip. The invention also relates to a brush, such as a body brush etc. to facilitate circulation of blood. The invention further relates to a rolling brush having a direction of rotation that can be selected at will be changing a switch. The invention further relates to a brush having teeth in which hair does not become entangled when the user is brushing hair or making a hair style.

BACKGROUND OF THE INVENTION

When using a conventional body brush or the like, liquid soap etc. is bubbled on the brush teeth, and the body of the user is washed by the teeth. In this case, the grip of the brush is generally grasped by the hand of the user, covered with soap. Accordingly, it is easy for the grip to slip and the brush is not easy to use. Such a problem also occurs in a hair brush when the hand of the user is covered with hair cream etc. As a means to solve the problem, a means of making a grip of a brush uneven to avoid slipping, is effective if used by a hand without soap, but is not sufficient to avoid slipping if grasped by a hand covered by soap. In order to increase an effect to avoid slipping by unevenness, the unevenness must be made sharp, and accordingly the brush is not safe to use.

In a conventional body brush, brush teeth made of horse hair etc. are implanted in a brush teeth implantation portion, and the user's body is washed by the brush teeth with soap. Since only brush teeth are implanted on the brush teeth implantation portion, it cannot give a strong stimulus to the surface of the user's body, and accordingly it is used solely to wash the body and has no function to facilitate circulation of blood.

As one example of a conventional rolling brush, there is a rolling brush shown in Japanese Utility Model Publication No. 54-41835. In the conventional rolling brush, as shown in FIG. 1, a heater and a fan are set inside a gripping portion, a blowing portion 5 is set around a connecting portion 4 with a brush base 3 on which a number of brush teeth 2 are implanted, and warm air blows from the blowing portion 5 to the hair.

As shown in FIG. 2, latches 6 and 7 having saw-shaped teeth in opposite directions are fixed at the end of the brush base 3. A supporting axis 8 projecting from the gripping portion 1 is inserted in an inserting hole set along the center axis of the brush base 3. The brush base 3 is rotated in one direction together with the gripping portion 1 by operating a direction changing switch 9. In the other direction of rotation of the base, only the gripping portion 1 is rotated and the brush base 3 is not moved.

As shown in FIG. 3, either an obstruction piece 10 or 11 projecting from the direction changing switch 9 contacts saw-shaped teeth 12, and the latches 6 and 7 rotate in direction Q together with the gripping portion 1, but are not rotated in direction P.

Numeral 13 is a supporting pin of the direction changing switch 9. In the conventional rolling brush, however, since the blowing portion 5 is placed at the end of the brush base 3, warm air blows to hair only from one direction, and it is not easy to blow equally to all the hair rolled by the brush teeth 2. Accordingly, balance for styling hair is not able to be made because of the difference of temperature of the warm air.

In order to make such a balance, the position of the brush teeth 2 must be changed many times, and accordingly it takes a long time to make hair styles, and hair is easily damaged because warm air blows to the hair for a long time. In the conventional rolling brush, furthermore, warm air blows from around the end of the brush base 3, and accordingly the outside diameter of the gripping portion 1 becomes large and not easy to grasp. Professionals who use the brush for a long time are easily tired.

Various kinds of brushes for hair have been made. In general, in the conventional brush, implantation density of brush teeth in a brush teeth implantation portion of the brush is uniform. Accordingly when density is small (brush teeth are thin), the hair is smoothly brushed but is difficult to be made glossy or voluminous. On the other hand, when the density is large (brush teeth are thick), the hair can be made glossy or voluminous but is not smoothly brushed, leading to increased falling out of hair.

SUMMARY OF THE INVENTION

Accordingly, it is an object of the invention to provide a brush having a grip which can be grasped without slipping, even by a hand covered with soap. To attain the object, according to the invention, the grip of a brush has a brush teeth implantation portion at one end thereof, and plural through-holes are placed at a certain interval spacing on and along the grip.

It is another object of the invention to provide a brush in an easy construction and at a low price which not only can wash a body but also facilitates circulation of blood at the time of washing. To attain this object, according to the invention, a brush comprises a grip and a brush teeth implantation portion connected thereto. Brush teeth and hard materials are implanted on the brush teeth implantation portion.

It is a further object of the invention to provide a rolling brush in which warm air blows equally to hair rolled by the brush from a brush base, by which hair styles can be made speedily without damage to hair, and which is easy to grasp not tiring even when the base is in use for a long time. To attain this object, according to the invention, a rolling brush comprises a brush base and a gripping portion which are connected by latches in opposite directions. A passage is set along the center axis of the brush base, and plural connecting holes are arranged in the passage, reaching through to an outside round surface of the brush base.

It is a further object of the invention to provide a brush which has a thin brush teeth portion and a thick brush teeth portion, by which hair is smoothly brushed and easily made glossy or voluminous, and is avoided from being damaged and from falling out. To attain this object, according to the invention, a brush comprises a grip and a brush teeth implantation portion, connected to the grip and on an outside round surface of which a number of brush teeth are implanted. Implantation density of the brush teeth on the brush teeth implantation portion is not uniform.

Other objects and features of this invention will become understood from the following description with reference to the accompanying drawings.

DESCRIPTION OF THE PREFERRED EMBODIMENT

The invention will be explained in more detail in conjunction with the appended drawings.

Figure 1:
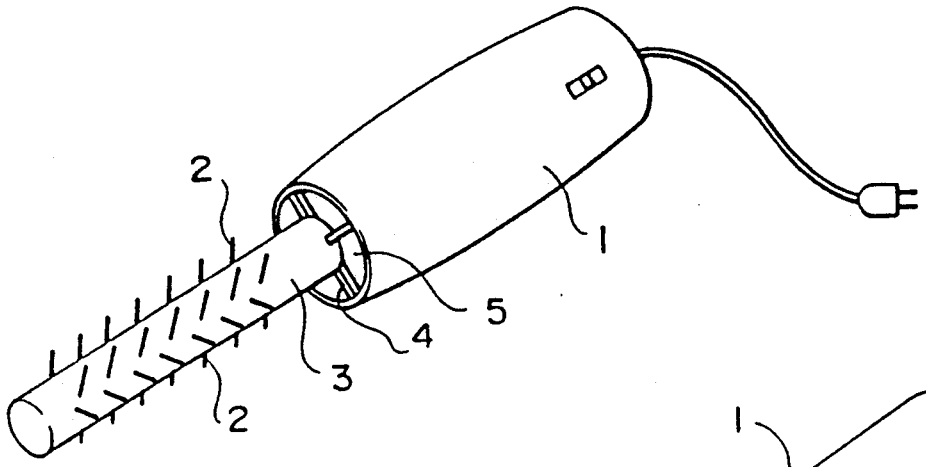
FIG.1 PRIOR ART
FIG. 1 and FIG. 2 are perspective views showing a conventional rolling brush.
Figure 2:
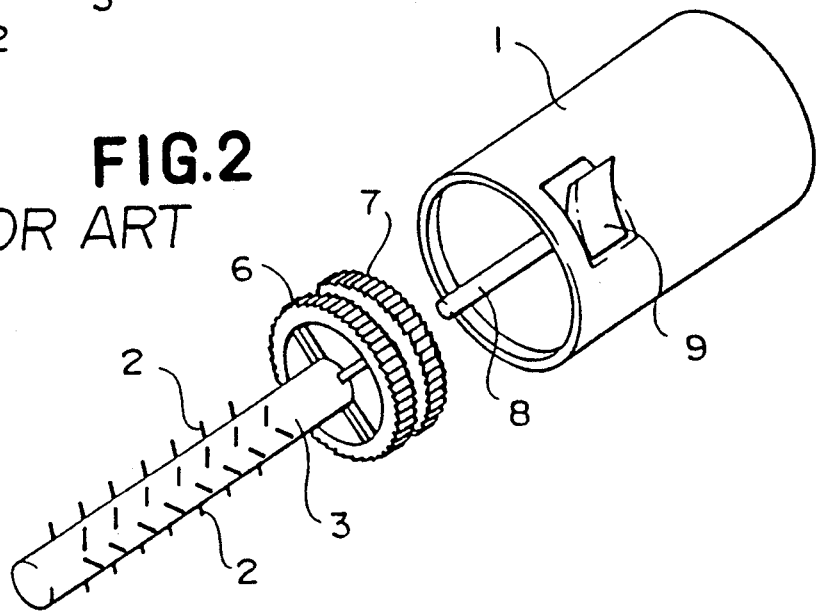
FIG.2 PRIOR ART
Figure 3:
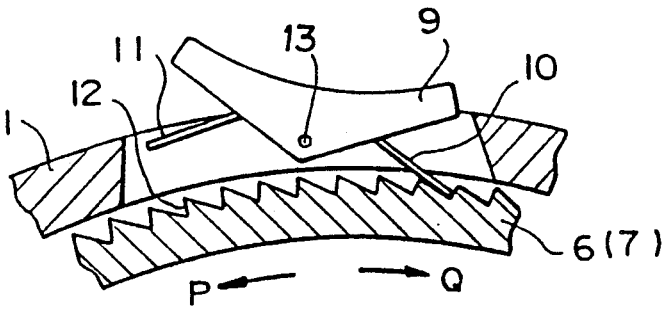
FIG.3 PRIOR ART
FIG. 3 is a sectional view showing an example of connection by latches of the conventional rolling brush.
Figure 4:
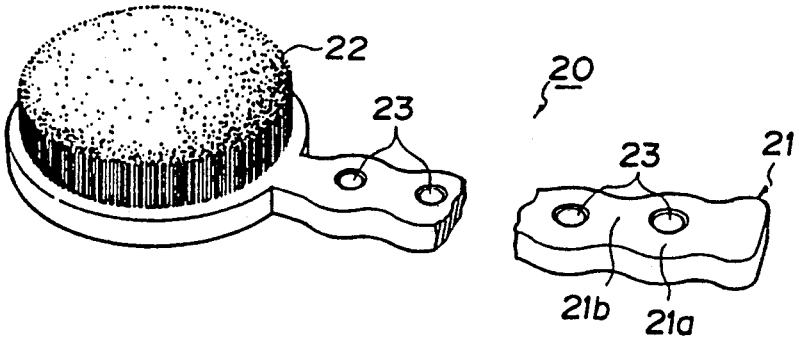
FIG. 4 is a perspective view showing structure of a body brush in the invention, a part of which is omitted.
Figure 5:
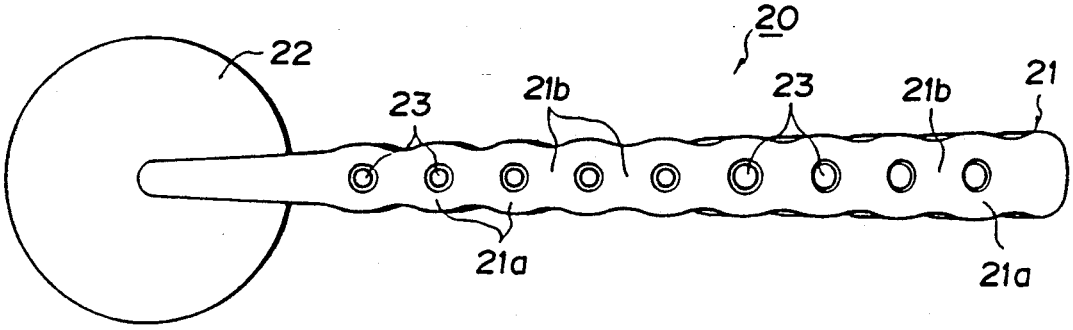
FIG. 5 is a plan view showing the body brush.
Figure 6:
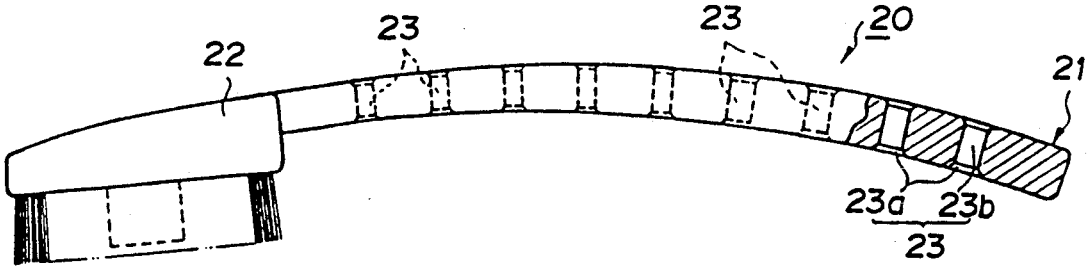
FIG. 6 is a front view showing the body brush.

FIGS. 4–6 show a body brush 20 to which the invention is applied. The body brush 20 in this embodiment comprises a grip 21 made of synthetic resin or wood having a shape for easy gripping, and a brush teeth implantation portion on an upper surface of an end of the grip 21.

As shown in FIG. 5, the shape of the grip 21 in a plan view is a continuing wave plane board, i.e., the sides of the grip have an undulating shape. As shown in FIG. 6, a shape thereof in a side view is curved like a bow, and through-holes 23 passing through in a vertical direction are placed at each broad portion 21*a* of the grip 21. The through-holes 23 can be placed at narrow portions 21*b* of the grip 21, not only at the broad portion 21*a*.

As shown in FIG. 6, the through-holes 23 are slightly broadened at both ends of through-hole portions 23*b*. When the grip 21 is grasped by the hand of a user and the hand is covered with soap, broadened portions 23*a* of the through-holes 23 work to remove the soap stuck to the palm, and the grip 21 is adsorbed on the palm by working of the through-holes 23. Accordingly the grip 21 does not easily slip even when grasped by a soapy hand, and washing is smoothly done.

In this embodiment, the shape of the brush teeth implantation portion 22 in a plan view is an approximate circle, and the grip 21 is formed as above. However, the invention is not limited thereto. The shape of the brush teeth implantation portion 22 in a plan view can be approximately oval, or the grip 21 can be formed in various shapes, such as a bar, etc.

Figure 7:
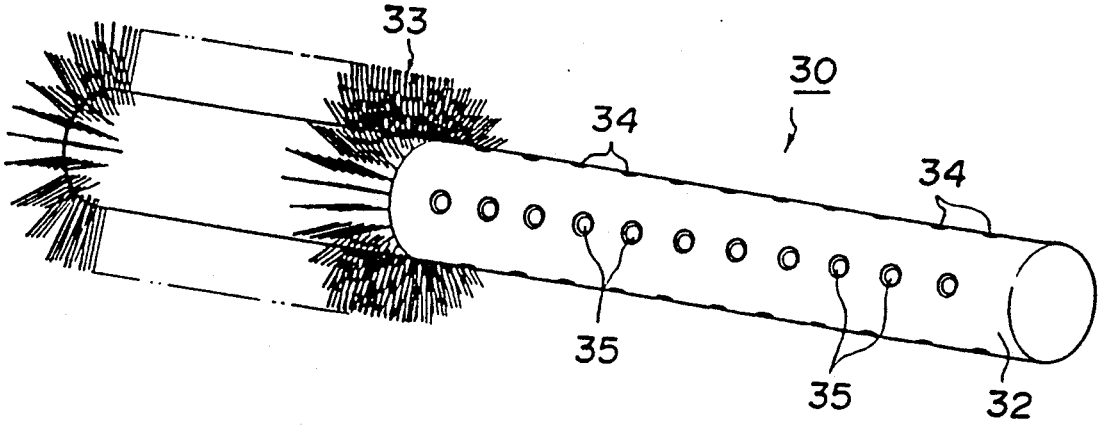
FIG. 7 is a perspective view showing structure of a hair brush in the invention.
Figure 8:
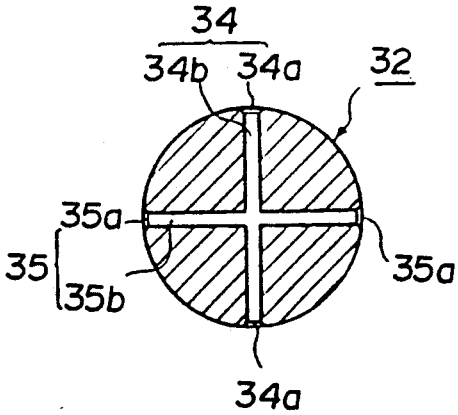
FIG. 8 is a magnified sectional view showing a grip of the hair brush.

FIG. 7 and FIG. 8 show a hair brush 30 to which the invention is applied. In the hair brush 30 in this embodiment, a brush teeth implantation portion 33 is formed at an end of a grip 32 having a rod shape, and vertical through-holes 34 passing through in a vertical direction and horizontal through-holes 35 passing through in a horizontal direction are placed on the grip 32.

As shown in FIG. 8 , the vertical through-holes 34 and the horizontal through-holes 35 are crossed in a sectional view, and both ends of through-hole portions 34*b* and 35*b* of the through-holes 34 and 35 are slightly broadened, similarly to the embodiment shown in FIGS. 4–6. When the grip 32 is grasped by a hand covered with hair cream etc., broadened portions 34*a* and 35*a* of the through-holes 34 and 35 work to remove the hair cream, etc. stuck to the palm, and the grip 32 is adsorbed on the palm by working of the through-holes 34 and 35. Accordingly the grip 32 does not easily slip even when grasped by a hand covered with hair cream etc. and brushing is smoothly done.

In this embodiment, the brush teeth implantation portion 33 and the grip 32 are formed in the shape shown in the figures. However, the invention is not limited thereto. For example, the brush teeth implantation portion 33 can be formed like conventional various hair brushes, or the grip 32 can be formed in various cross-sectional shapes, such as a square or an oval, etc.

According to the brush of the invention, plural through-holes are placed on a grip, explained as above. Accordingly, when the grip is grasped by a hand coated with soap or hair cream etc., broadened portions of the through-holes work to remove the soap or the hair cream, etc. stuck to the palm, and the grip is adsorbed on the palm by working of the through-holes. Accordingly the grip does not easily slip even when grasped by a hand coated with soap or hair cream etc., and washing or brushing is smoothly done.

Figure 9:
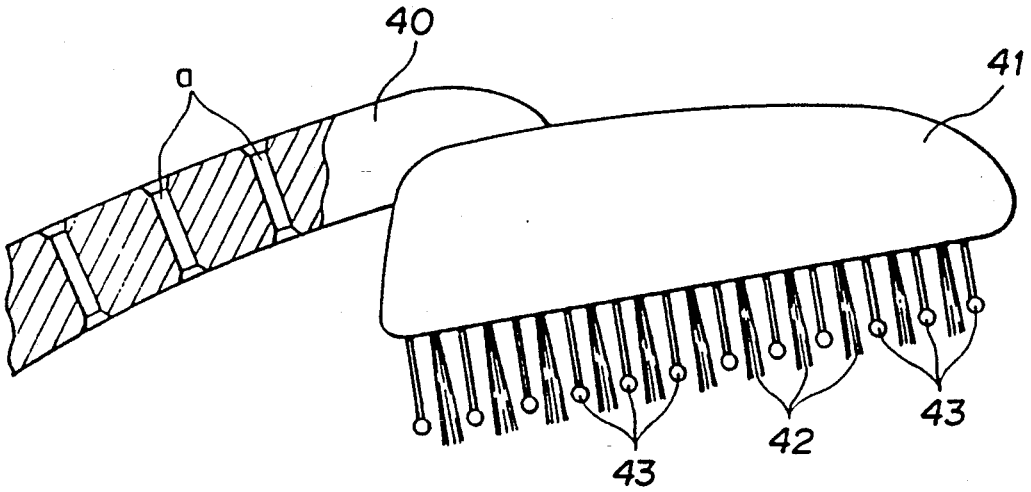
FIG. 9 is a side view showing a brush in an embodiment of the invention.
Figure 10:
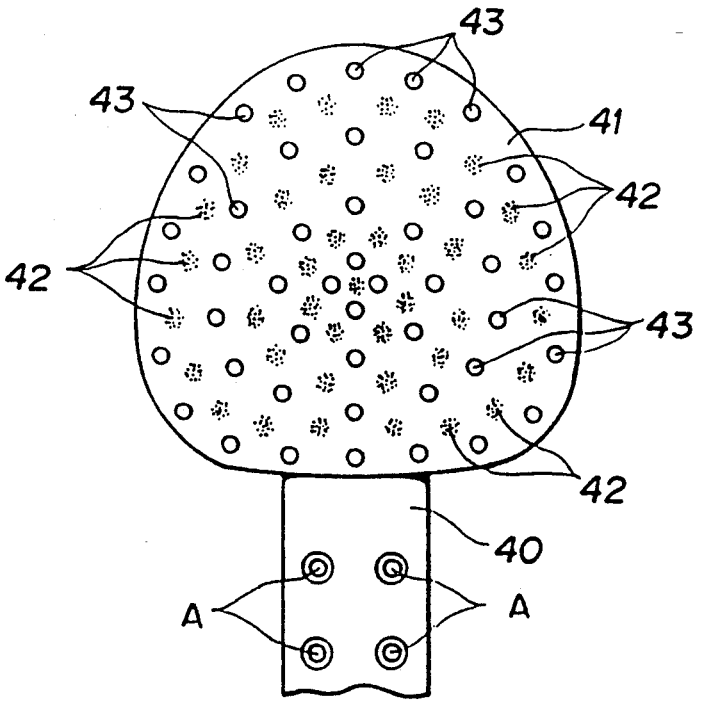
FIG. 10 is a front view showing an example of implantation of brush teeth.
Figure 11:
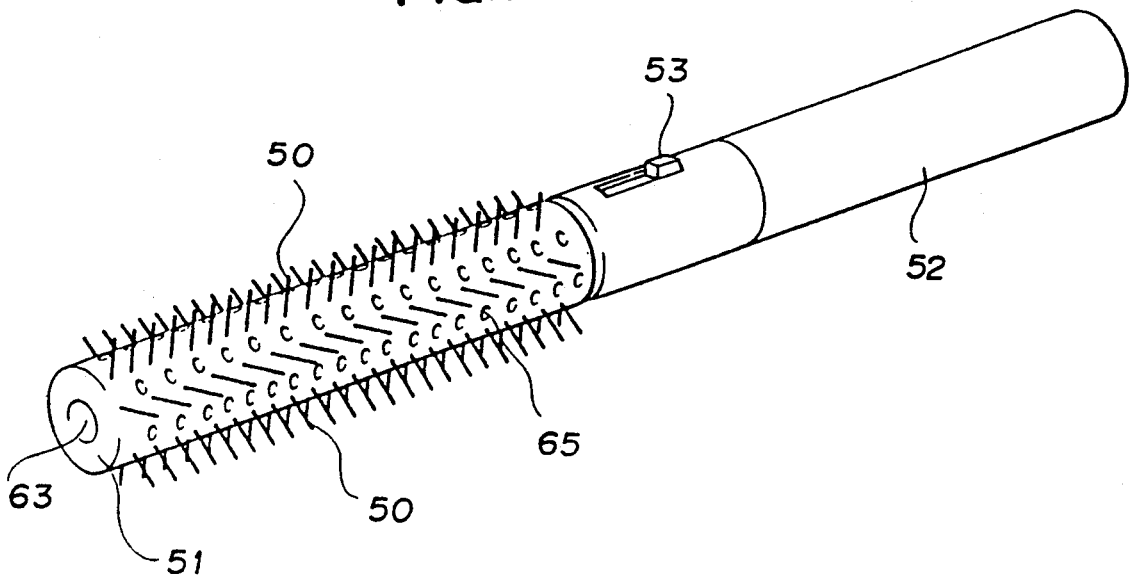
FIG. 11 is a perspective view showing a rolling brush in an embodiment of the invention.

As shown in FIG. 9 and FIG. 10, a brush in this embodiment comprises a grip 40 and a brush teeth implantation portion 41 formed as a single body, made of plastic or wood etc.

The grip 40 is shaped as a bar or cylinder having a proper thickness, in which plural through-holes A passing through in a direction intersecting its axis are placed at a certain interval spacing.

The through-holes A on the grip 40 are formed to work to remove the shampoo or soap, for example, stuck to the palm, when the grip 40 is grasped by the user's hand therewith, and accordingly the brush is prevented from slipping.

The brush teeth implantation portion 41 is connected to the grip 40, and a number of brush teeth 42 and hard materials 43 are implanted in the surface of the brush teeth implantation portion 41.

The brush teeth 42 are made of horse hair, pig hair, or soft synthetic resin, for example, and are slightly longer than the hard materials 43, as shown in FIG. 9.

The hard materials 43 are made of wood or hard synthetic resin, etc., and edges thereof are beaded so as not to hurt the surface of a user's body.

An example of implantation of the brush teeth 42 and the hard materials 43 is shown in FIG. 10. The brush teeth 42 and the hard materials 43 are implanted alternately. Plural hard materials 43 are implanted at a certain interval spacing along the edge of the brush teeth implantation portion 41 having an approximately circular shape. The brush teeth 42 are implanted at a certain interval spacing inside and along the row of the hard materials 43. The hard materials 43 are implanted at a certain interval spacing inside and along the row of the brush teeth 42, and so on. The implantation condition can be varied such that the brush teeth 42 and the hard materials 43 are implanted at random (not shown in figures).

Since the brush teeth 42 and the hard materials 43 are implanted on the brush teeth implantation portion 41 as above, when the brush teeth 42, covered with soap, etc., are moved on the user's body, the surface of the body is washed by the brush teeth 42. At the same time, the hard materials 43 are in contact with and press properly the body surface, and accordingly circulation of blood is facilitated. The brush teeth 42 are slightly longer than the hard materials 43, and accordingly no anxiety that bubbling of soap is not enough or that sufficient washing is not done will occur.

In this embodiment, the grip 40 and the brush teeth implantation portion 41 are formed as a single body. However, the invention is not limited thereto. For example, the brush teeth implantation portion 41 can be connected to the grip 40 by a universal joint to be moved and rotated freely and to enable the brush teeth 42 and the hard materials 43 to properly contact the body surface.

In this embodiment, hard materials 43 are implanted on the brush teeth implantation portion 41; however, the hard materials 43 and the brush teeth implantation portion 41 can be formed as a single body. Furthermore, the invention can be applied to brushes other than a body brush, such as a hair brush, etc.

According to a brush of the invention, brush teeth and hard materials are implanted on a brush teeth implantation portion, explained as above, and accordingly a desirable effect is that one brush not only can wash the user's body but also facilitates circulation of the blood at the time of washing. The brush can be provided at a low price because of easy construction, and so on.

Figure 12:
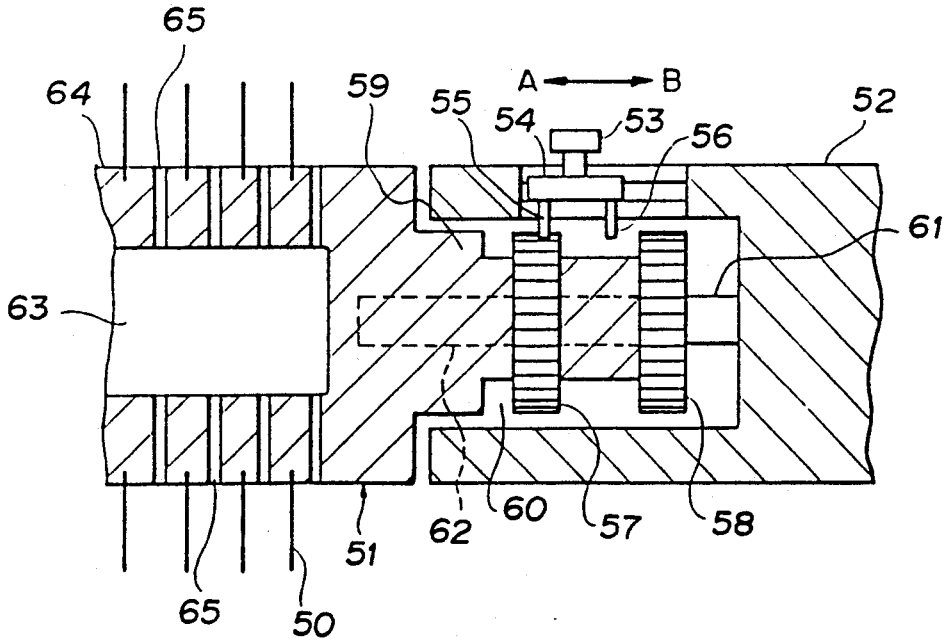
FIG. 12 is a sectional view showing an inside structure of the rolling brush.

A rolling brush in the embodiment is shown in FIG. 12, wherein numeral 50 is brush teeth, numeral 51 is a brush base on which the brush teeth 50 are implanted, numeral 52 is a gripping portion, and numeral 53 is a direction changing switch.

As shown in FIG. 12, two obstructing pieces 55 and 56 are set under a switching piece 54 of the direction changing switch 53 which slides in an arrow A - B direction. Either the obstructing piece 55 or 56 is in contact with latches 57 and 58 having saw-shaped teeth in opposite directions to each other. When the direction changing switch 53 is moved to the left side, the obstructing piece 55 is in contact with the latch 57, and the brush base 51 is rotated counterclockwise together with the gripping portion 52. When the gripping portion 52 is rotated clockwise, contact of the obstructing piece 55 is removed and only the gripping portion 52 is rotated.

When the direction changing switch 53 is placed at a neutral position, the obstructing pieces 55 and 56 are not in contact with the latches 57 and 58, and the brush base 51 and the gripping portion 52 are fixed when the gripping portion 52 is rotated counterclockwise or clockwise. The latches 57 and 58 are fixed at end of the brush base 51, and the brush base 51 and the gripping portion 52 are connected to be rotated by the obstructing pieces 55 and 56 and the latches 57 and 58. To secure the connection, a projecting portion 59 is formed at the end of the brush base 51, and is inserted in an indented portion 60 of the gripping portion 52. A supporting axis 61 projecting from the indented portion 60 is inserted in an inserting hole 62 set at the end of and along the axis of the brush base 51.

A passage 63 is formed along the center axis of the brush base 51, and plural connecting holes 65 connecting the passage 63 and an outside round surface 64 of the brush base 51 are placed along rows of the brush teeth 50.

According to a rolling brush, constructed as above, heater equipment (dryer equipment) is set at each seat in a beauty parlor, a flexible hose which is connected to the heater equipment and supplies warm air is attached to an edge of the passage 63 of the brush base 51, and the warm air can blow from the connecting holes 65 to hair. Usually, there is a large distance from the heater equipment to blowing portions of the connecting holes 65 traversed by the flexible hose. Accordingly, the temperature of the warm air generated in the heater equipment slightly lowers, which prevents the hair from being damaged. The warm air can blow equally to all the rolled hair from near the brush teeth 50, and accordingly hair styling is done efficiently and is completed in a short time.

Any materials can be used for the brush base 51; however, at least it is preferably that wood or resin coating, etc. is applied on the outside round surface to insulate heat. If the entire base of the brush is made of resin, mineral filler, etc. is mixed in heat resisting resin, such as polypropylene, polyolefine, etc., to provide a rolling brush light and easy to use.

According to a rolling brush of the invention, constructed as above, a desirable effect takes place since warm air can blow equally to all the hair rolled by the rolling brush, hair styling can be finished in a short time, and accordingly hair can be prevented from being damaged. Since a gripping portion of the brush can be formed more slender than that of the conventional rolling brush in which warm air blows from a gripping portion, it becomes very easy to grasp. Fatigue by hair specialists, etc. can be reduced, and so on.

Figure 13:
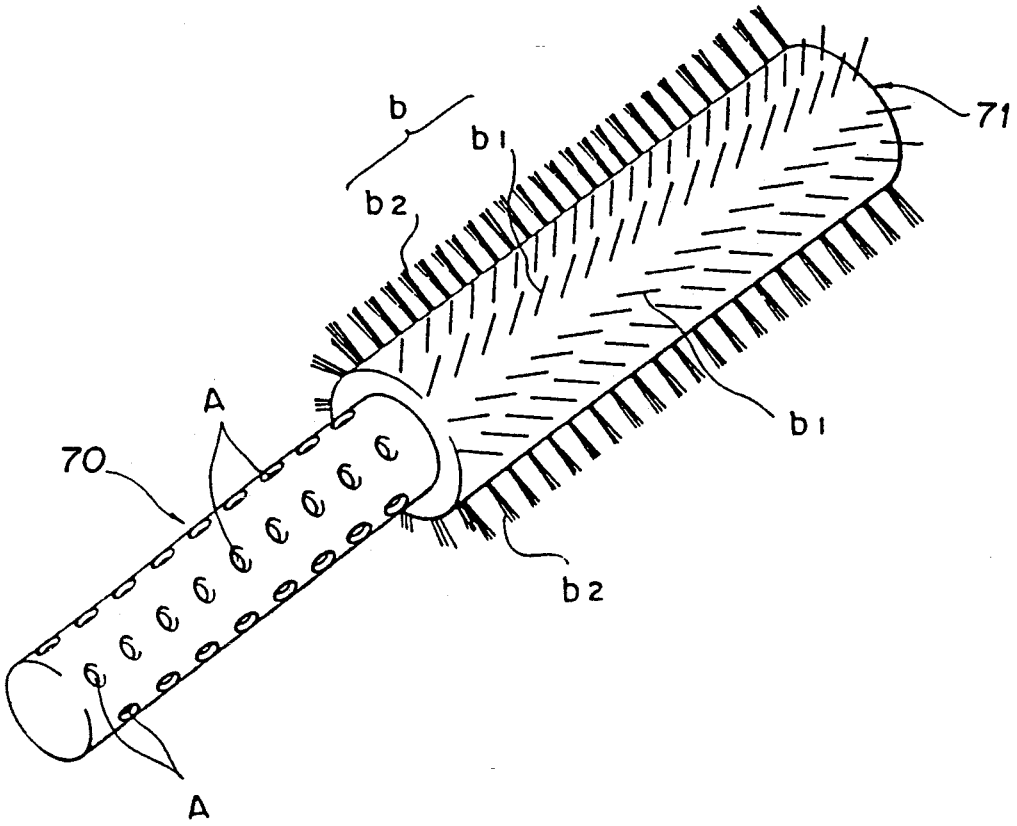
FIG. 13 is a perspective view showing a brush in an embodiment of the invention.

As shown in FIG. 13, a brush in the embodiment comprises a grip 70 and a brush teeth implantation portion 71 formed as a single body, made of plastic or wood etc.

The grip 70 is shaped as a rod or cylinder having a proper diameter, on which through-holes A passing through in a direction intersecting the axis are placed at a certain interval spacing.

The through-holes A on the grip 70 are formed to work to remove any oil or hair cream, for example, stuck to the palm, when the grip 70 is grasped by the user, and accordingly the brush is prevented from slipping.

The brush teeth implantation portion 71 is connected to the grip 70, and a number of brush teeth b are implanted on the outside round surface of the brush teeth implantation portion 71.

The brush teeth b are implanted in rows along the axis of the brush teeth implantation portion 71, and a small implantation density portion (hereinafter thin portion) b1 and a large implantation density portion (hereinafter thick portion) b2 are implanted radially in various forms.

Figure 14:
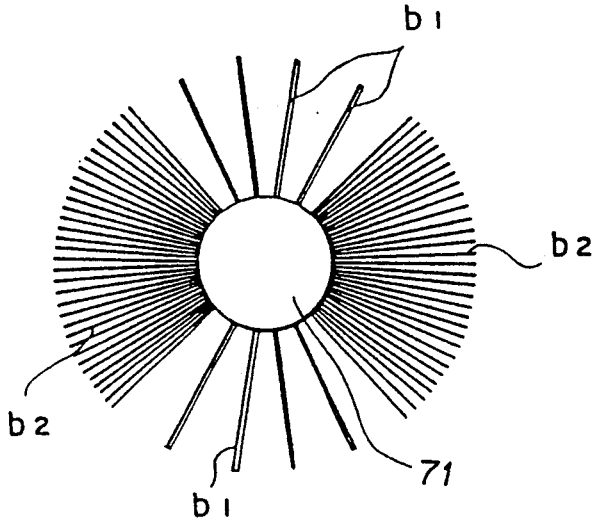
FIG. 14 is a front view showing an example of implantation of brush teeth in the brush.
Figure 15:
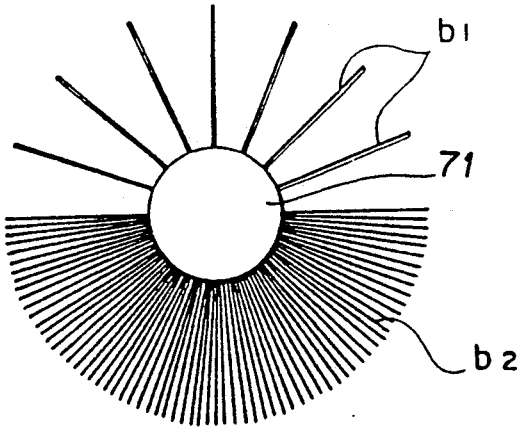
FIG. 15 is a front view showing another example of implantation of the brush teeth in the brush.

For example, the thin portion b1 and the thick portion b2 are implanted alternately along the outside round surface of the brush teeth implantation portion 71, as shown in FIG. 14, or the thin portion b1 is implanted on one half and the thick portion b2 is implanted on the other half of the outside round surface of the brush teeth implantation portion 71, as shown in FIG. 15. The cross-sectional shape of the brush teeth implantation portion 71 is not limited to a circle in the embodiment shown in the figures, but it can be formed as an oval or a polygon, for example. If the cross-section is formed as a polygon, implantation density of the brush teeth on each surface of the brush teeth implantation portion 71 is made different, respectively, and the thinnest, thinner, thin, the thickest, thicker, and thick portion, for example, can be used properly according to properties of hair, etc.

The thin portion b1 and the thick portion b2 are formed in one brush in this way, and when using the thin portion b1, hair can be smoothly brushed, and accordingly hair can be prevented from falling out. And when using the thick portion b2, hair can be easily made glossy or voluminous.

Furthermore, since one brush has the thin portion b1 and the thick portion b2, these portions can be used properly only by rotating the wrist. The brush is very easy to use for professionals, in particular, hair specialists, etc. Operating cost can be reduced because it is not necessary to provide two brushes having thin and thick brush teeth.

Although not shown in the figures, a brush in the embodiment can be constructed as, for example, the brush teeth implantation portion 71 is in the form of a cylinder. An end of a duct, the other end of which is connected to dryer equipment, is attached to an opening made at the end of the brush teeth implantation portion 71. Warm air supplied through the duct blows from plural air supplying holes placed on the brush teeth implantation portion 71. Alternatively, dryer equipment may be set in the grip 70.

In the embodiment, materials such as horse hair, etc. are used as brush teeth to be implanted on the brush teeth implantation portion 71. However, the invention is not limited thereto. For example, conventional materials, such as plastic, etc. can be used.

According to the invention, a thin brush teeth portion and a thick brush teeth portion are formed in one brush. Accordingly, hair can be smoothly brushed and easily be made glossy or voluminous, can be prevented from being damaged, from falling out, and so on.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A body brush, comprising a grip defining an elongate handle and a body brush teeth implantation portion at an end thereof, said implantation portion containing a plurality of brush bristles extending generally perpendicular to a lengthwise direction of the elongate handle, said elongate handle including a plurality of through-holes each having first and second opposite ends defining a longitudinal axis therebetween and formed at spaced locations from each other along substantially the entire length of the handle, the longitudinal axis of each of said through-holes respectively extending generally in the same direction as the brush bristles, wherein adjacent through-holes are spaced sufficiently close to each other so that a user's hand engaging the handle simultaneously contacts at least two said adjacent through-holes which have the function of removing soap from the user's hand during gripping to prevent slippage of the handle in the hand, wherein said elongate handle and the brush teeth implantation portion are formed as a generally continuous curve in side profile along the entire length of the brush and is thereby arcuately shaped.

2. The body brush according to claim 1, wherein the handle has a pair of peripheral edges formed with a plurality of undulations defining along each edge, alternating concave and convex gripping surfaces extending along substantially the entire length of the handle and spaced sufficiently close together so that a plurality of said concave surfaces and a plurality of said convex surfaces on each edge are simultaneously engaged by the user's hand during use.

3. The body brush according to claim 1, wherein the ends of each of the through-holes are slightly flared.

4. A body brush according to claim 1, wherein there are at least three said through-holes, wherein the elongate handle includes a pair of opposing first surfaces and a pair of second surfaces respectively extending between to interconnect longitudinal edges of said first surfaces to thereby define said handle with said first surfaces, said ends of said through holes respectively intersecting said first surfaces, and wherein said first surfaces are of greater surface area than the surface areas of the second surfaces.

* * * * *